US010112428B2

(12) United States Patent
Mueller

(10) Patent No.: US 10,112,428 B2
(45) Date of Patent: Oct. 30, 2018

(54) SHAPING TOOL AND DEVICE FOR SHAPING BOOK COVERS

(71) Applicant: Mueller Martini Holding AG, Hergiswil (CH)

(72) Inventor: Hans Mueller, Lauda-Koenigshofen (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 15/492,030

(22) Filed: Apr. 20, 2017

(65) Prior Publication Data

US 2017/0305183 A1 Oct. 26, 2017

(30) Foreign Application Priority Data

Apr. 21, 2016 (CH) ..... 534/16

(51) Int. Cl.
*B42C 11/04* (2006.01)
*B42C 7/00* (2006.01)

(52) U.S. Cl.
CPC ..... *B42C 7/004* (2013.01); *B42C 7/005* (2013.01)

(58) Field of Classification Search
CPC ..... B42C 11/04; B42C 7/00
USPC ..... 412/19–21
See application file for complete search history.

(56) References Cited

U.S. PATENT DOCUMENTS

| | | | | |
|---|---|---|---|---|
| 3,201,810 | A | 8/1965 | Throp | |
| 5,868,539 | A * | 2/1999 | Rathert | B42C 11/04 281/21.1 |
| 6,460,843 | B1 * | 10/2002 | Dim | B42C 11/04 270/58.07 |
| 7,407,355 | B2 * | 8/2008 | Schmidkonz | B42C 11/045 412/19 |
| 2002/0168250 | A1 | 11/2002 | Welch | |
| 2011/0123298 | A1 | 5/2011 | Mueller | |
| 2015/0273926 | A1 | 10/2015 | Meineke et al. | |

FOREIGN PATENT DOCUMENTS

| | | | |
|---|---|---|---|
| DE | 1436086 | A | 1/1969 |
| DE | 19853254 | A1 | 5/2000 |
| EP | 2325020 | A1 | 5/2011 |
| EP | 2923852 | A2 | 9/2015 |

* cited by examiner

*Primary Examiner* — Shin H Kim
(74) *Attorney, Agent, or Firm* — Leydig, Voit & Mayer, Ltd.

(57) ABSTRACT

A shaping tool for a device for rounding a spine region and for shaping a folding region of a lying outstretched book cover, the folding region being adjacent on either side of the spine region, in accordance with a shape of a spine of a book block, which subsequently forms a book together with the book cover, includes a fixed, convex central shaping strip. Two convex outer shaping rails laterally adjoin the central shaping strip and are laterally adjustable according to a required rounding and width of the spine region of the book cover.

15 Claims, 7 Drawing Sheets

SHAPING TOOL AND DEVICE FOR SHAPING BOOK COVERS

CROSS-REFERENCE TO PRIOR APPLICATION

Priority is claimed to Swiss Patent Application No. CH 00534/16, filed on Apr. 21, 2016, the entire disclosure of which is hereby incorporated by reference herein.

FIELD

The invention relates to a shaping tool for a device for rounding a spine region and for shaping a folding region of a lying outstretched book cover, the folding region being on either side of the spine region, in accordance with the shape of the spine of a book block in each case, which subsequently forms a book together with a book cover, and to a device having at least one such shaping tool.

BACKGROUND

The industrial finishing of hardcover books is predominantly carried out on book production lines on which book blocks are each combined with an associated book cover to produce finished books. During so-called casing in, i.e. when the book cover is bonded to the book block, the exact joining of their edges is crucial for a harmonious binding. Therefore, the prior adjustment and, if necessary, shaping of the central region of the book cover, i.e. the spine region, which receives the spine of the book block in the finished book, is of importance for a high quality of book. Of similar importance is the shaping of the folding regions of the book cover which directly adjoin the central region on either side and later constitute the opening hinges of the finished book. The requirements for the shaping of the book cover, which is carried out under the effect of heat in each case, and therefore for the shaping tool used for this purpose differ according to whether the finished book has a rounded or angular spine and according to the form of the rounding and according to the thickness of the book. Accordingly, the shaping tools must be designed so as to be adjustable and/or interchangeable.

A book binding machine comprising a casing-in apparatus is known from DE1436086 A, in which the book cover is conveyed from a magazine into a shaping station. There, the spine region of the book cover is first rounded by a shaping tool. In order to form the folding regions separating the spine region from the lateral boards of the book cover, two fold-forming rails are guided in opposite directions at least as far as the book cover while the shaping tool is being raised. This procedure, which is only described in very general terms in DE1436086 A, can be seen in more detail in DE19853254 A1, which describes a device for rounding book covers. Therein, the spine region of the book cover is pressed against an elastically deformable supporting surface by means of a heated shaping tool designed according to the shape of the book block. In the process, the spine region is rounded and the pressed-in folding regions are made flexible. Normally, the shaping tools are kept available in conventional shape-dependent tiers and when the spine shape of the book cover or the thickness category of the associated book block changes, they are swapped over. Accordingly, the production of books with different thicknesses requires keeping a large number of corresponding shaping tools available, which causes relatively high costs for the shaping tools and thus also for the entire device for shaping book covers.

Moreover, the manual changeover of the shaping tools that is required for this purpose increases the time it takes to set up the machine. Ultimately, the newly inserted shaping tools are not yet at an operating temperature and must therefore first be heated up after their installation.

An apparatus for shaping book covers for books having straight spines is known from EP2325020 A1. The shaping tool of said apparatus, which is interchangeable depending on the thickness category of the books to be produced in each case, has two shaping rails which stand vertically, are spaced apart from one another and each rest on a tool beam by means of a base rail. The shaping rails are arranged in an initial position below and apart from the book cover, which is initially still in an outstretched position. In order to form the folding regions of the book cover provided on either side of the spine region, the shaping rails are raised together with their tool beam against counter shaping rails arranged thereabove. To shape the book cover, heat is applied via the shaping tools. For this purpose, the tool beam carrying the shaping tool rests on an intermediate element which is designed as a heating element and is equipped with heating rods. The shaping tool is both brought up to an operating temperature and kept at this temperature by the heating element.

The shaping rails are each coupled to two catches, which are spaced apart from one another in their longitudinal extension, are rotatably driven eccentrically about a vertical axis and are guided in the tool beam, in a guide plane by means of their respective base rails. The spacing between the two support rails and therefore the width of the spine region of the book cover can be adjusted within a certain thickness category by an adjustment of the catches achieved by means of a common drive. In the process, the actuating power is introduced into the tool beam by means of an actuating mechanism arranged therebelow. An actuator is arranged in parallel with a longitudinal axis of the shaping tool.

EP2923852 A2 likewise relates to a device for shaping book covers. In addition to a first shaping tool for book covers which are intended for book blocks having straight spines, a second shaping tool is disclosed for book covers which are suitable for book blocks having round spines. Using the second shaping tool, the spine region of a book cover can be rounded while it is being raised from its outstretched position, it being possible to produce different formats and contours of the spine region. For this purpose, this shaping tool has a base element in which a first shaping element is movably arranged. In the process, in the event of a longitudinal movement of the first shaping element, the elevation of said first shaping element can also be changed relative to the base element by means of a ramp-like guide. In the same manner, a second shaping element is arranged in the first shaping element such that both shaping elements can be adjusted towards one another or towards the base element in a vertical plane relative to the flat outstretched book cover. Within a particular thickness category of spine regions, both the width and the curvature of the spine region of book covers to be processed after one another can thus be shaped differently as required without changing over the shaping tools.

SUMMARY

In an embodiment, the present invention provides a shaping tool for a device for rounding a spine region and for shaping a folding region of a lying outstretched book cover, the folding region being adjacent on either side of the spine region, in accordance with a shape of a spine of a book block which subsequently forms a book together with the book cover. The shaping tool includes a fixed, convex central shaping strip, and two convex outer shaping rails, which laterally adjoin the central shaping strip and are laterally adjustable according to a required rounding and width of the spine region of the book cover.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
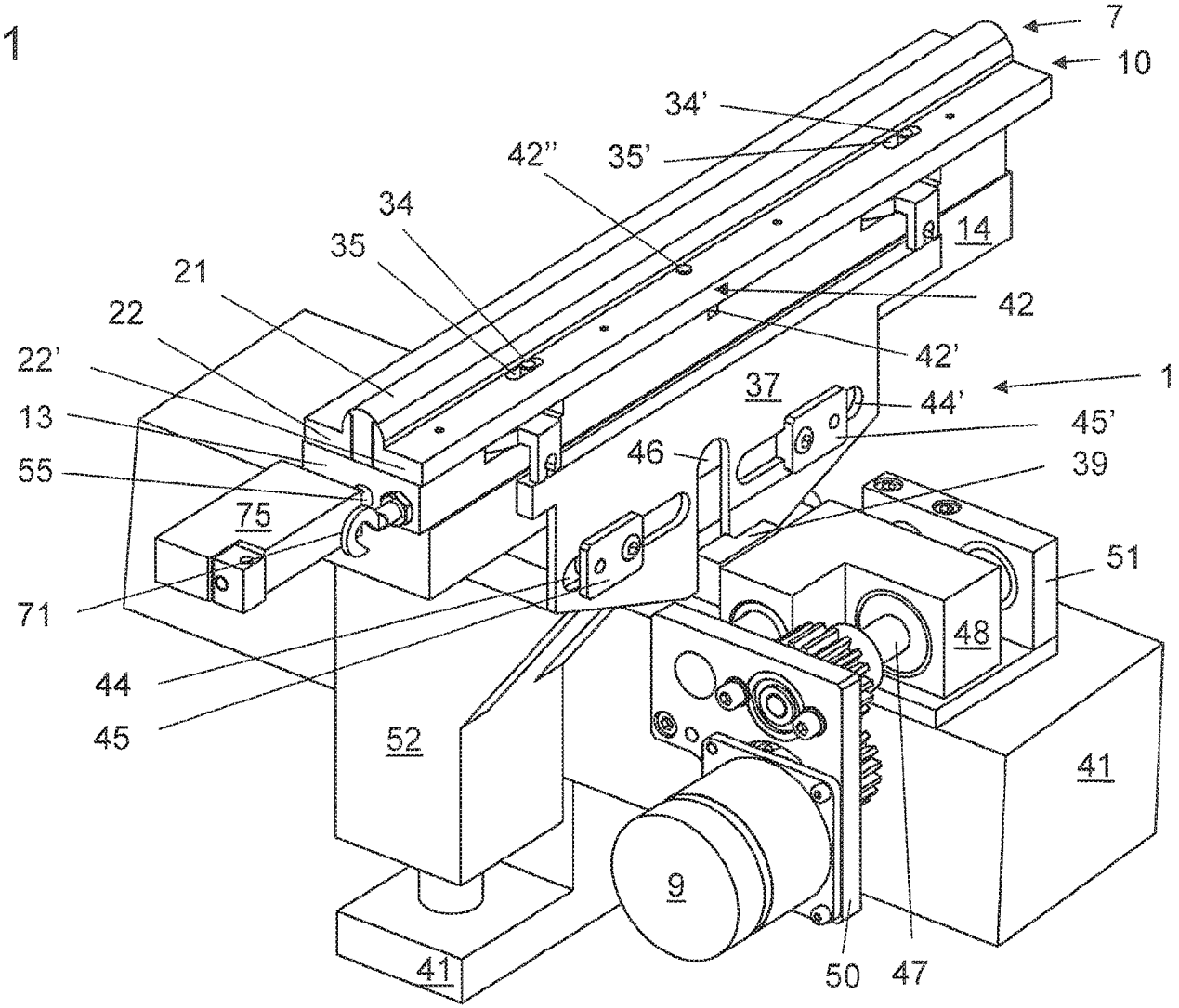
FIG. 1 is a three-dimensional partial view of the device according to an embodiment of the invention for shaping book covers lying outstretched, showing a shaping tool according to an embodiment of the invention, an actuator by way of example and its connecting element to the shaping tool.

The inventor has recognized that the two shaping elements of the shaping tool described above, which are to be adjusted separately, each require a separate drive and separate connecting elements, meaning that the shaping tool is relatively complex and expensive. Owing to the adjustment of the two shaping elements in the vertical direction, the forces occurring during the shaping of the spine region of the book covers must be absorbed by the connecting elements and/or the drive, which can lead to an impairment of the quality of the rounding to be formed of the spine region owing to the clearance that exists in each case. Moreover, vertical gaps are formed both between the base element and the first shaping element and between the first and the second shaping element of the shaping tool. When shaping the spine regions to be shaped, which mostly consist of paper and/or cardboard, parts of the material can break loose and penetrate said vertical gaps. As a result, the function of the shaping tool and therefore also of the device for shaping book covers accommodating at least one such shaping tool can be impaired. Finally, either no assistance for the shaping by an additional application of heat via the shaping tools is provided or a newly installed shaping tool still has to be preheated before its first use.

An embodiment of the invention therefore provides a simple and cost-effective shaping tool and a device having at least one such shaping tool for rounding the spine region of book covers lying outstretched and for shaping a folding region adjacent to either side of the spine region, in accordance with the shape of the spine of a book block in each case, which subsequently forms a book together with one of the book covers. Moreover, the shaping tool and the device are intended to be adjusted in a simple manner to a thickness and/or shape of the spine region to be shaped that differs in a subsequent order, and a consistently good quality of the rounding of the spine region is to be ensured.

The shaping tool according to an embodiment of the invention has a fixed, convex central shaping strip and two likewise convex, outer shaping rails which laterally adjoin the central shaping strip and are laterally adjustable according to the required rounding and width of the spine region of the book cover.

Such a simple and cost-effective shaping tool can very simply and quickly be adapted according to a subsequent order with differing thickness and/or shape of the spine region to be shaped by means of a corresponding lateral adjustment of the outer shaping rails. Moreover, a consistently good quality of the rounding of the spine region and of the shaping of the folding region which adjoins it on either side can be thus ensured.

According to one embodiment, the shaping tool according to the invention has a tool beam, which is non-positively or positively connected to the central shaping strip and the outer shaping rails. Such a tool beam can advantageously receive different shaping tools and transmit the required lifting and adjusting movements to the shaping tool that has been received in each case.

According to another embodiment of the shaping tool according to the invention, the central shaping strip is symmetrical and, in a region facing the tool beam, has one recess on either side for receiving the outer shaping rails at least in part. The outer shaping rails can thus enter into the contour of the central shaping strip in order to adjust the rounding and the width of the spine region of the book cover, which allows a relatively large adjusting range of the shaping tool.

According to another embodiment of the shaping tool according to the invention, the outer shaping rails are designed so as to be adjustable symmetrically to a longitudinal central axis of the central shaping strip. Similarly to the symmetrical design of the book block, the book covers can therefore also be shaped symmetrically. This can advantageously be achieved by means of one single actuator.

The device according to the invention for shaping a spine region and a book cover lying outstretched on either side of a folding region adjacent to the spine region is advantageously equipped with at least one shaping tool according to the invention.

In one embodiment of the device according to the invention, at least one shaping tool is arranged so as to interact with a countertool which is aligned with an outer face of the spine region of the book covers. Here, the countertool has two counter shaping rails, which are arranged apart from one another and are laterally adjustable according to the width of the spine region of the book cover. Using such a device, the spine region of book covers which are to be processed consecutively and are made from different materials can also be rounded and shaped to a particularly good quality.

In another embodiment of the device according to the invention, at least two different shaping tools are arranged, which are suitable for different thickness categories of spine regions of the book covers to be shaped. For example, a device equipped with two different shaping tools according to the invention can shape book covers for corresponding book blocks having a thickness of up to 60 mm. When using the device according to the invention, very few shaping tools are accordingly needed in order to cover a relatively large thickness range of book covers to be shaped.

In another embodiment, the device according to the invention has a working position for a first shaping tool and a resting position for at least one second shaping tool in each case. A specific position for the at least one shaping tool, which is not located in the working position, is advantageously provided by the resting position.

In another embodiment of the device according to the invention, the first shaping tool, which is located in its working position, is arranged so as to be aligned with an inner face of the spine region of a book cover, to raise the spine region of the book cover between the two counter shaping rails and, in the process, to form a spine strip of the book cover.

In another embodiment of the device according to the invention, at least one preheating station is arranged in the device for the at least one second shaping tool located in the resting position. As a result of the presence of the at least one preheating station, the shaping tool required for a new works order can be conveyed, such that it is already preheated, out of the resting position into the working position. Therefore, the new shaping tool is immediately ready for operation, as a result of which a relatively short order changeover can be achieved. Since the preheating station of the shaping tools is located in the device and therefore in the direct vicinity of the place of use, the hot shaping tools are accommodated so as to be protected from unauthorized access. The production orders can be grouped together by a corresponding production control system according to the change in format and the efficiency of the machine can be increased since subsequent orders can be run with the same preheated shaping tool.

In the next embodiment of the device according to the invention, an individual preheating station is arranged for each shaping tool. As a result, an even quicker changeover of the shaping tools and therefore a quicker change in format can take place, which increases the capacity of the device.

According to another embodiment of the device according to the invention, at least one sensor is arranged for identifying the shaping tools. As a result of this identification, an error-free assignment of the shaping tools to each works order and ultimately likewise an increase in capacity is already possible beforehand.

According to another embodiment of the device according to the invention, the at least one sensor is arranged in at least one of the preheating stations and is aligned with a shaping tool which is located in its resting position or the at least one sensor is arranged on a receiving element for the tool beam and is aligned with a shaping tool which is located in its working position. As a result, a plurality of options advantageously emerges for the identification of the shaping tools depending on the works order.

In another embodiment of the device according to the invention, the tool beam of the shaping tool arranged in the working position in each case is designed such that it can be coupled to an actuator. Here, said actuator is arranged to the side of an imaginary, vertical plane through a longitudinal central axis of the tool beam which is located in its working position. The device can therefore be constructed in a very compact manner.

As a result of the low number of shaping tools required in the case of the device according to the invention, it is possible to assign each shaping tool its own coded preheating station, the temperature of which can be adjusted depending on the book cover to be processed. The temperature settings of the different materials are stored in the machine control system and can be assigned on the basis of the existing order data of the subsequent orders to the coded preheating stations. Additionally, it is possible as a result of the coding of the shaping tools for their use in the machine to be monitored and incorrect settings to thus be prevented.

The gradation of the shaping tools according to thickness categories depends on other interchangeable parts of the book production machine such that efficient within this grade is ensured. The gradations are therefore defined in relation to the book thickness such that within one gradation no interchangeable parts need to be changed over in any region of the book production line.

FIG. 1 is a partial view of a device 1 according to the invention for shaping book covers 2 lying outstretched (FIG. 5, FIG. 7), which are each subsequently assembled together with a book block which has a round spine to make a book. Such a book cover 2 essentially consists of two lateral book boards 3, 3' and a central part referred to as a spine region 4 which receives the spine of the book block (FIG. 4 to FIG. 9). On its inner face, the spine region 4 can be provided with a strengthening insert 5 consisting for example of cardboard or recycled paper (FIG. 5, FIG. 7). The book cover 2 has one folding region 6, 6' on either side of the spine region 4 and connects said spine region to the book boards 3, 3' and forms an opening hinge in the finished book (FIG. 4 to FIG. 8).

As shown in FIG. 1, the device 1 is equipped with a first shaping tool 10, which is located in a working position 7 and, moreover, has been moved out of a lowered position into a raised position and is coupled to an actuator 9 designed as a drive motor. For example, spindle or worm drives can of course also be used as the actuator.

Figure 2:
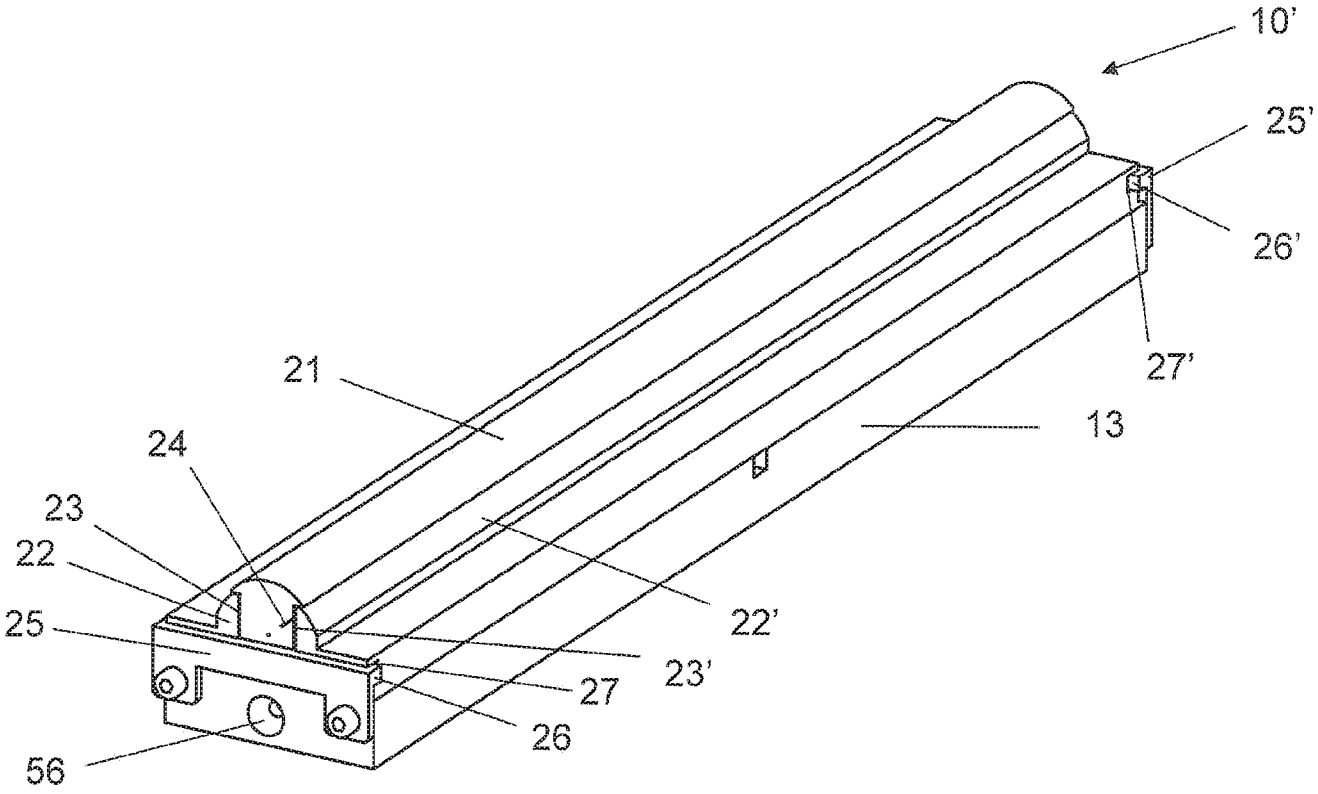
FIG. 2 is an enlarged view of the shaping tool according to an embodiment of the invention.

FIG. 2 is an enlarged view of a second shaping tool 10', according to the invention, of the device 1. The second shaping tool 10' is then coupled to the actuator 9 when the next book cover 2 to be shaped requires a different thickness category of spine regions 4 according to a subsequent production order. When shaping using the first or the second shaping tool 10, 10', the two folding regions 6, 6' are each shaped and their spine region 4 is rounded out of the stretched position such that the shaped book cover 2' is then suitable to be bound to a corresponding book block to form a book.

As likewise shown in FIG. 1, the first shaping tool 10 has a fixed, convex central shaping strip 21 and two likewise convex, outer shaping rails 22, 22 to the sides of the central shaping strip 21 which adjoin said shaping strip and are laterally adjustable according to the required rounding and width of the spine region 4 of the book cover 2 to be shaped. The central shaping strip 21 and the two outer shaping rails 22, 22' rest on a common tool beam 13 and are non-positively or positively connected to said beam. Moreover, the two outer shaping rails 22, 22' are arranged on the tool beam 13 such that they can be laterally offset. In this manner, the outer shaping rails 22, 22' can be adjusted according to the required width of the spine region 4 of the book cover 2.

On their underside, the outer shaping rails 22, 22' are, for example, provided with permanent magnets or with electromagnets, which can be switched on and off, which generate relatively high attraction forces on the upper face of the ferrous tool beam 13. These attraction forces provide for close contact between the upper face of the tool beam 13 and the outer shaping rails 22, 22' such that good heat transfer into said outer shaping rails 22, 22' and therefore onto the book cover 2 to be shaped is ensured.

Figure 3:
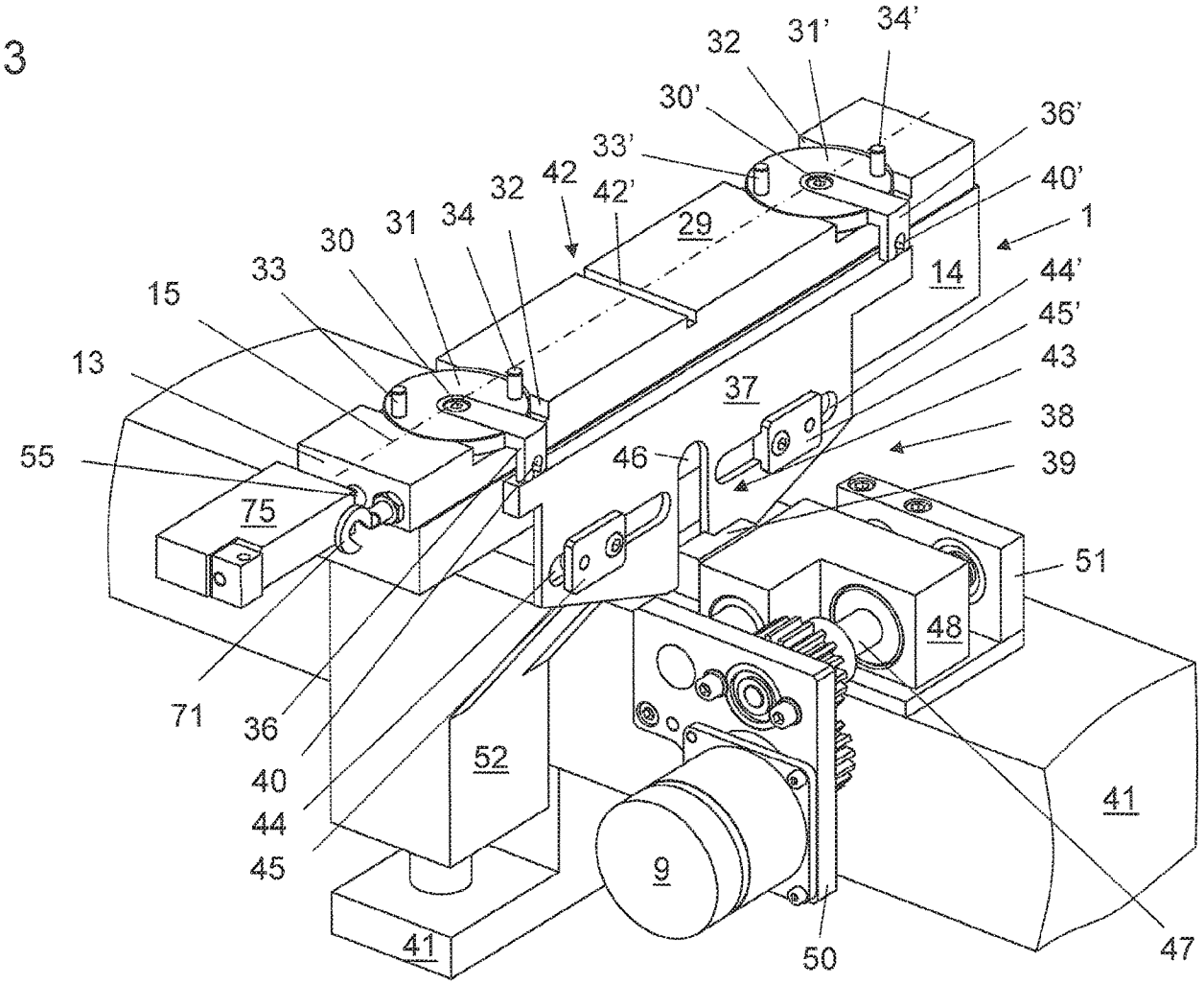
FIG. 3 is a view of the device from FIG. 1, with the shaping tool removed.

The tool beam 13 is approximately the length of the outer shaping rails 22, 22' and is wider than the spacing between the outer shaping rails 22, 22' required for the largest book cover 2 to be shaped using the device 1. The tool beam 13 located like the first shaping tool 10 in its working position 7 rests on a receiving element 14 of the device 1. The actuator 9 is arranged to the side of an imaginary, vertical plane through a longitudinal central axis 15 of the tool beam 13 (FIG. 3). The outer shaping rails 22, 22' are arranged symmetrically to a longitudinal central axis 24 of the central shaping strip 21 and are designed so as to be adjustable symmetrically to this longitudinal central axis 24.

Figure 4:
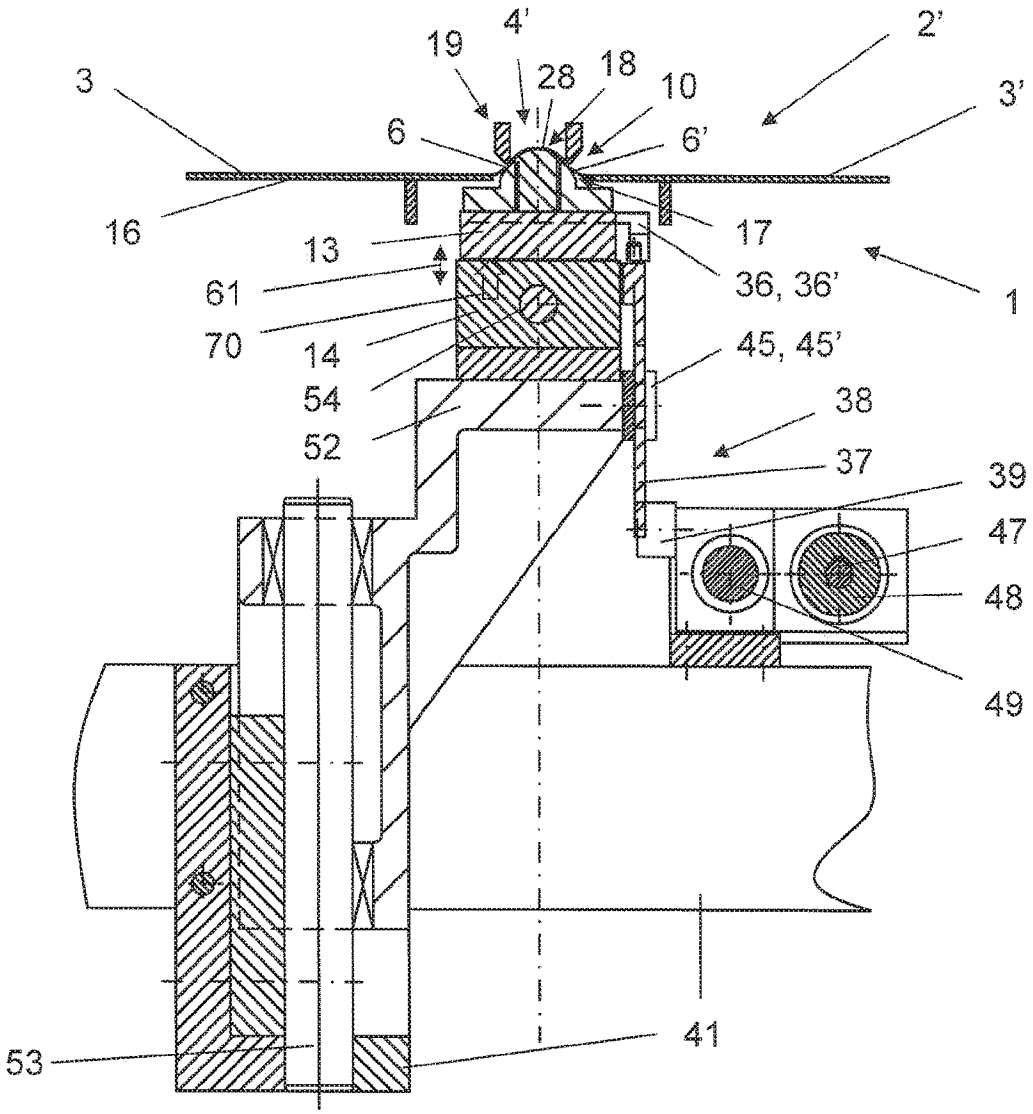
FIG. 4 is a cross-section of the device shown in FIG. 1, showing a countertool and a shaped book cover.
Figure 5:
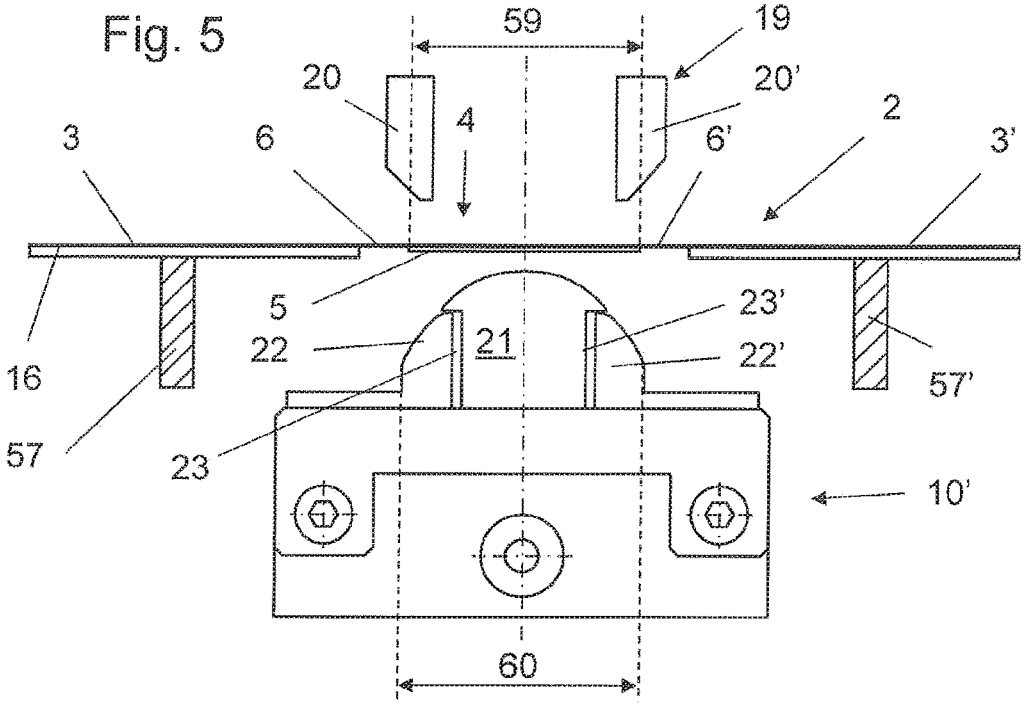
FIG. 5 is a detail of the device according to an embodiment of the invention, showing the shaping tool according to an embodiment of the invention, the countertool and a book cover of a first format ready for shaping.

In its lowered position, the first shaping tool 10 which at least almost extends over the height of a book cover 2 is initially located underneath and spaced apart from a supporting flat surface 16 used for shaping and shown in FIG. 4, which extends transversely to the feed direction of the book block of a casing-in machine which is arranged downstream of the device 1 and is used to connect the book block to the rounded book covers 2'.

In addition to the shaping tool 10, which is located in the working position 7 in each case and is aligned with an inner face 17 of the spine region 4 of a book cover 2 to be shaped, the device 1 also has a countertool 19 which is arranged above the shaping tool 10, interacts with said shaping tool and is aligned with an outer face 18 of the spine region 4, 4' which is to be shaped or has been shaped of said book cover 2'. The countertool 19 has two counter shaping rails 20, 20' which are spaced apart from one another, stand vertically and are oriented in parallel with the spine region 4 of the book cover 2 to be shaped (FIG. 5, FIG. 7). These are likewise designed so as to be mutually adjustable according to the required width of the spine region 4 of the book cover 2.

According to FIG. 2, the second shaping tool 10' according to the invention also has a fixed convex central shaping strip 21 aligned towards the countertool 19 in the working position (FIG. 5) and two convex outer shaping rails 22, 22', which are arranged to the sides of the central shaping strip 21, are laterally adjustable according to the rounding and the width of the spine region 4 of the book cover 2 to be shaped and likewise aligned towards the countertool 19 in the working position 7. The central shaping strip 21 is symmetrical and has, in a region facing the tool beam 13, one recess 23, 23' on either side for each receiving the outer shaping rails 22, 22' at least in part. Said outer shaping rails are designed so as to be adjustable symmetrically to a longitudinal central axis 24 of the central shaping strip 21.

In addition to the attraction forces already described above, two end-face guides 25, 25' can absorb the processing forces during shaping of the relevant book cover 2. For this purpose, two protrusions 26, 26' of each of the two end-face guides 25, 25' penetrate into end-face grooves 27, 27' in the outer shaping rails 22, 22' and hold these in contact with the tool beam 13. The two end-face guides 25, 25' can be set such that they withstand a thermal expansion of several hundred degrees Celsius without impairment and do not counteract a slight movement of the outer shaping rails 22, 22'.

In order to shape the folding regions 6, 6' of the book cover 2 provided on either side of the spine region 4, the relevant shaping tool 10, 10' together with the tool beam 13 is first raised against the countertool 19 arranged thereabove and its counter shaping rails 20, 20' and, in the process, a spine strip 28 of the book cover 2' is formed using the central shaping strip 21 and the outer shaping rails 22, 22'. In the process, the convex curvatures of the central shaping strip 21 and the outer shaping rails 22, 22' of the shaping tool 10, 10', which is located in its working position 7 in each case, ensure the rounding of the raised spine strip 28 and therefore of the spine region 4' of the book cover 2' according to the rounding of the spine of an associated book block.

FIG. 3 is a partial view of the device 1 according to the invention with the shaping tool 10, 10' removed. A smooth support surface 29 of the tool beam 13, which acts as a flat feed surface, is consequently visible, and has good sliding properties for the shaping tool, 10, 10'which is located in its working position 7 in each case. As can be seen, the tool beam 13 is also used to receive rotating members, for example discs 31, 31' which are driven, for example, about vertical axes of rotation 30 30' and are mounted in recesses 32, 32' in the tool beam 13 which are spaced apart from one another along the tool beam 13. On their side aligned with the shaping tool 10, 10' located in its working position, the discs 31, 31' have catches 33, 34, 33', 34' opposite one another in relation to the relevant axis of rotation 30, 30'.

The discs 31, 31' are recessed into the tool beam 13 such that they do not touch the shaping tool 10, 10' located in the working position 7. In their side resting on the tool beam 13, the shaping tools 10, 10' each have recesses 35, 35' which are aligned in parallel with the axis of rotation 30, 30' of the discs 31, 31', and are at least partially penetrated by the catches 33, 34, 33', 34' designed for example as studs. Only the corresponding interaction between one of the catches 34, 34' and the recesses 35, 35' in the outer shaping rail 22', which is at the front in FIG. 1, of the first shaping tool 10 is shown. The rear outer shaping rail 22, of course, also has corresponding, albeit hidden, recesses 35, 35', in each of which one of the catches 33, 33' engages.

In order to achieve an optimally effective, mutually opposing lateral stroke of the outer shaping rails 22, 22' of the shaping tool 10, 10', which is located in its working position 7 in each case, can be achieved, the catches 33, 34, 33', 34' of a disc 31, 31' are aligned in an initial position, for example, at an angle of approximately 45° to the longitudinal central axis 15 of the tool beam 13 so as to be diametrically opposite one another (FIG. 3). The rotary movements of the discs 31, 31' are achieved by a movement cam 36, 36' fastened on the circumference of each disc 31, 31' and projecting laterally over the tool beam 13, by means of a slider 37 of a sliding device 38 which is connected to an actuating cam 39. An even change in the distance between the outer shaping rails 22, 22' of the shaping tool 10, 10' is thus ensured. The adjustment and setting of this distance can be achieved by means of a motor force or manual force. To increase accuracy, a control system connected to a variable motor can also be used.

The movement cams 36, 36' protruding on one side of the tool beam 13 are connected by means of joints 40, 40' or lateral guides to the slider 37 which is mounted on a frame 41 of the device 1 in an oscillating manner or so it can be moved back and forth. As a result of joint rotation of the discs 31, 31', the catches 33, 34, 33', 34' each move inwards or outwards and, in the process, reduce or enlarge the distance between the outer shaping rails 22, 22' of the shaping tool 10, 10'.

So that the outer shaping rails 22, 22' of the shaping tool 10, 10' do not move relative to one another in their longitudinal direction when the discs 31, 31' rotate, a first guide arrangement 42 is provided between the tool beam 13 and the shaping tool, 10, 10', which is located in the working position 7 in each case, is transverse to the longitudinal extension of said tool, and, for example, has a groove 42' in the tool beam 13 extending transversely to the longitudinal extension of said components and has a pin 42" (FIG. 1) or similar of the shaping tool 10, 10' engaging therein. In this manner, it is ensured that the outer shaping rails 22, 22' are only adjustable transversely to the longitudinal extension of the relevant shaping tool 10, 10'. This constitutes an alternative solution to the end-face guides 25, 25' described above.

FIG. 4 is a cross section of the device 1 equipped with a first shaping tool 10 and a countertool 19 and an already shaped book cover 2' having a rounded spine region 4' and having the two shaped folding regions 6, 6'. Shown here is the arrangement of the shaping tool 10 likewise connected to the frame 41 and the sliding device 38 connected to the shaping tool 10 by means of the slider 37. The slider 37, which is connected to the discs 31, 31' in a drivable manner and extends downwards in a flat manner, has a second guide arrangement 43 (FIG. 3), which provides for its slidability in parallel with the longitudinal extension of the tool beam 13. The second guide arrangement 43 has two slots 44, 44' which extend in this sliding direction and are spaced apart from one another and one slide block 45, 45' fastened to the frame 41, assigned to each of the slots 44, 44' and entering said slots, on which the slider 37 is moved back and forth.

Between the slots 44, 44', a slot-like opening 46 reaching from the bottom upwards (FIG. 1, FIG. 3) is provided for the actuating cam 39, which is designed as a catch and is indirectly connected to the actuator 9. The opening 46 allows raising and lowering of the first shaping tool 10 which is connected to the frame 41.

As can be seen from FIGS. 1, 3 and 4, the actuator 9 shown is a geared motor, the drive shaft 47 of which is designed as a spindle. The drive shaft 47 passes through and meshes with a spindle nut of a regulating element 48 guided on a rod 49 in the direction of the sliding movements of the slider 37, to which element the actuating cam 39 is fastened. In order to mount the drive shaft 47, a bearing shield 50 connected to the frame 41 and a bearing block 51 are provided. Instead of this, a rack and pinion drive can of course also be provided as the regulating device.

According to FIG. 4, the raising of the first shaping tool 10 takes place by means of a bracket 52, which is connected to the receiving element 14 of the tool beam 13 and interacts with a known piston-cylinder unit or with another lift drive along a guide rod 53 fixed to the frame 41 of the device 1. As a result of the raising of the first shaping tool 10 (cf. the stroke 61 indicated by means of a double arrow) the spine region 4' of the book cover 2' is raised up and shaped under the effect of heat by means of the central shaping strip 21 and the two outer shaping rails 22, 22' between the opposing counter shaping rails 20, 20' of the countertool 19 so as to form a spine strip 28. In the process, the folding regions 6, 6' located on either side of the spine region 4' are also shaped into opening hinges. For this purpose, the receiving element 14 which is arranged underneath the tool beam 13 is designed as a heating element and is equipped with heating rods 54, from which the heat is transferred via the tool beam 13 and the central shaping strip 21 and the shaping rails 22, 22' to the spine region 4 of the book cover 2 to be shaped in order to keep the shaping tool 10 at the operating temperature.

For accurate positioning of the shaping tool 10, 10', for example a centering apparatus 75 connected to the receiving element 14 is provided with a conical positioning pin 55 (FIG. 1, FIG. 3) and is engaged under spring pressure in a drilled hole 56 provided therefor (FIG. 2) on the end face of the tool beam 13.

With respect to the further configuration of the drive and the connecting elements to form the shaping tools 10, 10' of the device 1, reference is made to EP2325020 A1 mentioned at the outset, which is to be understood to be an integral component of the device 1 in this respect.

Figure 9:
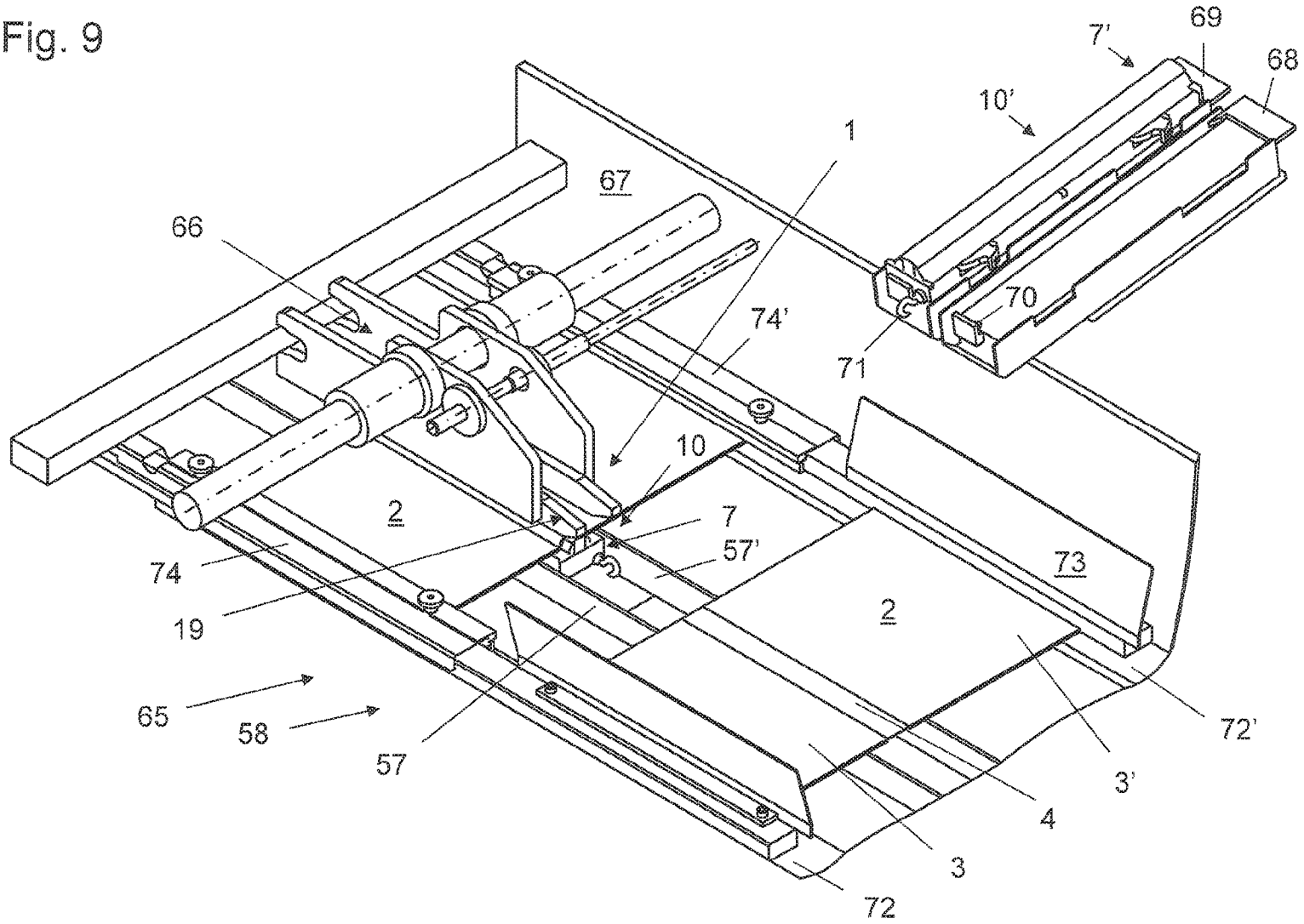
FIG. 9 is a perspective plan view of a device according to an embodiment of the invention, which is integrated in a cover feed by way of example, which in turn has two preheating stations for shaping tools.

FIG. 5 shows a detail of the device 1 showing the second shaping tool 10' in its working position 7, showing the counter shaping rails 20, 20' of the countertool 19 and a book cover 2 ready to be shaped lying on inner support elements 57, 57' of a cover feed 58 (FIG. 9). The second shaping tool 10' is still located in its lowered position, i.e. underneath the flat support surface 16, and is therefore at a distance from the book cover 2. In this position, the second shaping tool 10' is adjusted to a width 59 of the insert 5 of the spine region 4 of the book cover 2. For this purpose, the outer shaping rails 22, 22' of the second shaping tool 10' on the support surface 29 (FIG. 3) of the tool beam 13 are pushed further into the recesses 23, 23' in the central shaping strip 21 or further out of said recesses 23, 23' depending on the width 59 of the insert 5. The shape and equivalent radius of the second shaping tool 10 are determined by a thus adjusted external width 60 of the outer shaping rails 22, 22'.

Figure 6:
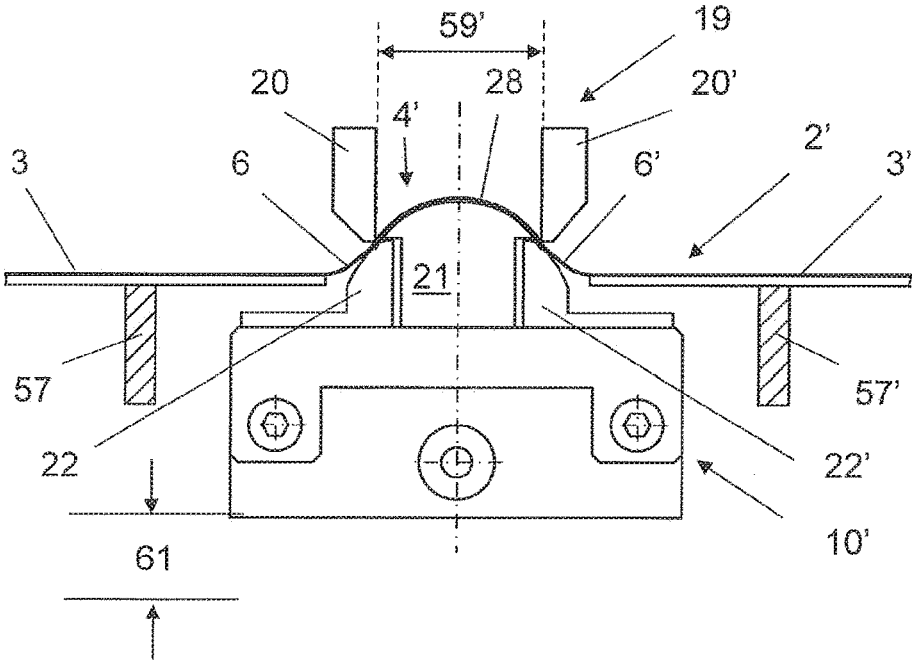
FIG. 6 is a detail of the device according to FIG. 5, but with a rounded book cover.
Figure 7:
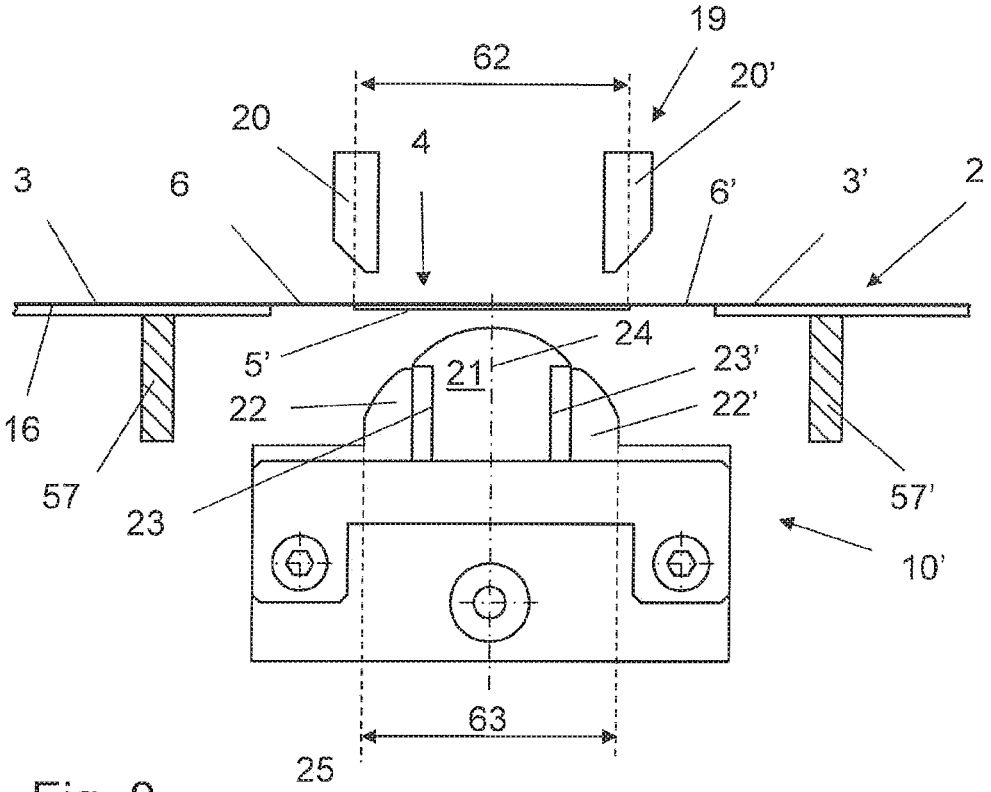
FIG. 7 is a detail of the device similar to FIG. 5, but with a book cover of a second format.

FIG. 6 shows the second shaping tool 10' in its position in which it has in the meantime been raised upwards by one stroke 61 out of the position shown in FIG. 5. The stroke 61 depends on the thickness of the relevant book block and of the associated book cover 2 and is calculated by a machine control system and is transferred to the second shaping tool 10' as already described above. After shaping, the insert 5 and therefore the now rounded spine region 4' of the book cover 2' has shortened from its original width 59 to a projected width 59' thus forming a spine strip 28, inner edges of the counter shaping rails 20, 20' ending in outer edges of the insert 5. The projected width 59' of the insert 5 therefore corresponds to a thickness of the associated, rounded and backed book block.

Similarly to FIG. 5, FIG. 7 shows a detail of the device 1, showing the second shaping tool 10' likewise located in its lowered position of the working position 7, showing the counter rails 20, 20' of the countertool 19 and a book cover 2 having a different format ready to be shaped, which is associated with a rounded and backed book block having a different thickness. The second shaping tool 10' is therefore adjusted to a width 62 of an insert 5', which has a different format, of the spine region 4 of the book cover 2, which likewise has a different format. As a result of a corresponding movement of the outer shaping rails 22, 22' on the tool beam 13 to a second external width 63, the new shape and equivalent radius of the second shaping tool 10' is adjusted. To do this, in contrast to the view in FIG. 5, the outer shaping rails 22, 22' have been adjusted outwards symmetrically to the longitudinal central axis 24 of the central shaping strip 21.

Figure 8:
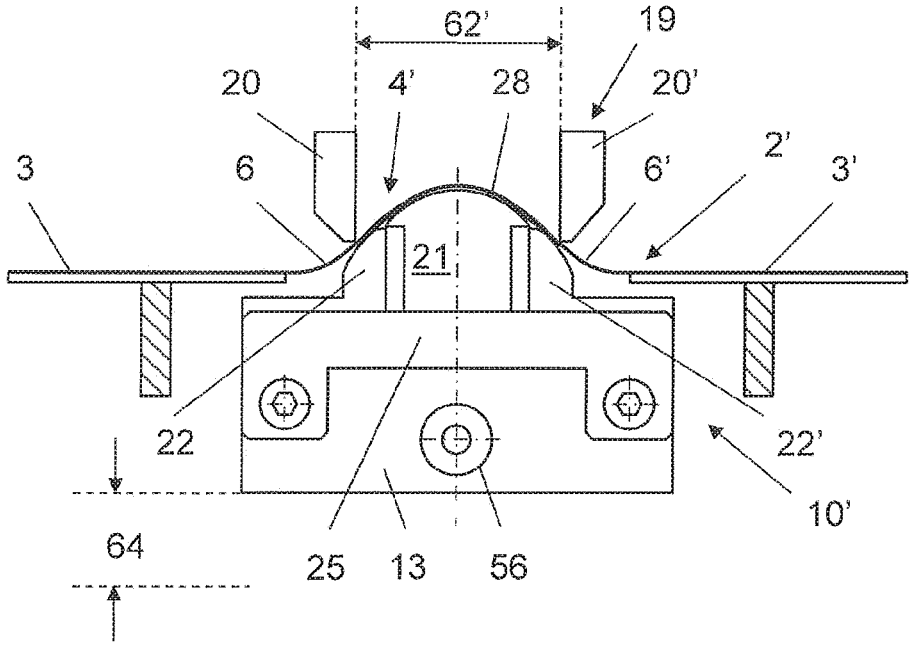
FIG. 8 is a detail of the device according to FIG. 7, but with a rounded book cover of the second format.

Similarly to FIG. 6, FIG. 8 shows the second shaping tool 10', which has, however, been adjusted according to FIG. 7 in its position in which it has in the meantime been raised upwards by one stroke 64 out of the position shown in FIG. 7. After shaping, the insert 5', which has a different format, of the spine region 4 and therefore the now rounded spine region 4' of the book cover 2' has been shortened from the original width 62 to a projected width 62', inner edges of the counter shaping rails 20, 20' likewise aligning with the outer edges of the insert 5'. The stroke 64 of the second shaping tool 10' has, as described with reference to FIG. 6, been calculated and automatically adjusted.

FIG. 9 is a perspective view of a device 1 according to the invention and of two shaping tools 10, 10' suitable for different thickness categories of spine regions 4 of the book covers 2 to be shaped.

The device 1 is integrated by way of example in the cover feed 58 of a book production line 65, which is merely indicated here. In this view, the device 1 is accordingly largely hidden by the cover feed 58 and the book covers 2 located thereon. Consequently, in FIG. 9 all that can be seen of the device 1 is the countertool 19 comprising a suspension bracket 66 in a machine frame 67 of the cover feed 58 and a shaping tool 10 accommodated in the device 1 in its working position.

Likewise integrated in the cover feed 58 are two preheating stations 68, 69, i.e. one separate heating station 68, 69 for each shaping tool 10, 10'. When the device 1 is in operation, one of the shaping tools 10, 10' is always installed in the device 1. According to FIG. 9, the first shaping tool 10 is located in the device 1, while the second shaping tool 10' is in the preheating station 69 and is currently being heated up or is waiting at its set temperature for its next use. It is therefore in a resting position 7'.

The preheating station 68 provided for the shaping tool 10 which is installed in the device 1 is currently empty. Empty preheating stations 68, 69 can be set to a lower temperature directly by the machine operator or via a control system. In the process, which heating station 68, 69 is currently empty is monitored, as is which shaping tool 10, 10' is therefore located in the device 1 and whether this shaping tool 10, 10' is suitable for the current order. The preheating stations 68, 69 can be structurally designed such that they are each only suitable for receiving one particular shaping tool 10, 10'. In the example in FIG. 9, only the shaping tool 10 which is currently in its working position 7 would then fit in the empty preheating station 68.

Even though a quicker format change of the book covers 2 to be shaped can thus be achieved, a separate preheating station 68, 69 of course does not have to be arranged for each shaping tool 10, 10'. Generally, it is sufficient if the shaping tool 10, 10' to be transported into its working position 7 in each case can be taken out of its resting position 7' in a preheating station 68, 69.

In order to monitor which preheating station 68, 69 is currently empty and which shaping tool 10, 10' is therefore located in the device 1 and whether this shaping tool 10, 10' is suitable for the current order, an appropriate sensor 70 can be arranged. For example, the sensor 70 can be arranged in at least one of the preheating stations 68, 69 (FIG. 9) and aligned with a shaping tool 10' located in its resting position 7'. Alternatively, the sensor 70 can also be fastened to a receiving element 14 for the tool beam 13 (FIG. 4) and aligned with a shaping tool 10 located in its working position 7.

According to FIG. 1 and FIG. 9, the shaping tools 10, 10' each have a lifting hook 71 on an end face of their tool beam 13. This is used to lift a shaping tool 10, 10' out of and install it in its working position 7 or resting position 7' by means of lifting gear.

Finally, in addition to the two inner support elements 57, 57', the cover feed 58 also has two outer support elements 72, 72' for the book covers 2, a support apparatus 73 for introducing book covers 2 and safety rails 74, 74' for preventing the book cover 2 from raising up during the shaping process.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A shaping tool for a device for rounding a spine region and for shaping a folding region of a lying outstretched book cover, the folding region being adjacent on either side of the spine region, in accordance with a shape of a spine of a book block which subsequently forms a book together with the book cover, the shaping tool comprising:

a fixed, convex central shaping strip; and two convex outer shaping rails, which laterally adjoin the central shaping strip and are laterally adjustable according to a required rounding and width of the spine region of the book cover.

2. The shaping tool according to claim 1, wherein the shaping tool has a tool beam which is non-positively or positively connected to the central shaping strip and the outer shaping rails.

3. The shaping tool according to claim 2, wherein the central shaping strip is symmetrical and has a recess on either side in a region facing the tool beam configured to receive the outer shaping rails at least in part.

4. The shaping tool according to claim 1, wherein the outer shaping rails are designed so as to be adjustable symmetrically to a longitudinal central axis of the central shaping strip.

5. A device for rounding a spine region and for shaping a folding region of a lying outstretched book cover, the folding region being adjacent on either side of the spine region, in accordance with a shape of a spine of a book block which subsequently forms a book together with the book cover, the device comprising:

at least one shaping tool comprising:

a fixed, convex central shaping strip and two convex outer shaping rails, which laterally adjoin the central shaping strip and are laterally adjustable according to a required rounding and width of the spine region of the book cover.

6. The device according to claim 5, wherein the at least one shaping tool is arranged so as to interact with a countertool which is aligned with an outer face of the spine region of the book cover.

7. The device according to claim 6, wherein the countertool has two counter shaping rails which are spaced apart from one another and are adjustable laterally according to the width of the spine region of the book cover.

8. The device according to claim 5, wherein the device includes at least two different shaping tools, which are configured for different thickness categories of spine regions of book covers to be shaped.

9. The device according to claim 8, wherein the device has a working position for a first shaping tool and one resting position each for at least one second shaping tool.

10. The device according to claim 9, wherein the first shaping tool which is located in the working position is arranged so as to be aligned with an inner face of the spine region of the book cover and is configured to raise the spine region of the book cover between the two counter shaping rails and so as to form a spine strip of the book cover.

11. The device according to claim 9, further comprising at least one preheating station arranged for the at least one second shaping tool which is located in the resting position.

12. The device according to claim 11, wherein a separate preheating station is arranged for each shaping tool.

13. The device according to claim 5, further comprising at least one sensor configured to identify the shaping tools.

14. The device according to claim 13, wherein the at least one sensor is arranged in at least one preheating station and is aligned with a second shaping tool located in a resting position, or is arranged on a receiving element for a tool beam and is aligned with the at least one shaping tool located in a working position.

15. The device according to claim 5, wherein a tool beam of a respective shaping tool arranged in a working position is designed such that the tool beam is coupleable to an actuator, which is arranged to a side of an imaginary, vertical plane through a longitudinal central axis of the tool beam arranged in the working position.

* * * * *